US009209532B2

(12) United States Patent
Charette

(10) Patent No.: US 9,209,532 B2
(45) Date of Patent: Dec. 8, 2015

(54) GANGED HOUSING FOR COAXIAL CABLE CONNECTORS

(71) Applicant: Keith Charette, Westport, CT (US)

(72) Inventor: Keith Charette, Westport, CT (US)

(73) Assignee: Ventus Networks LLC, Norwalk, CT (US)

( * ) Notice: Subject to any disclaimer, the term of this patent is extended or adjusted under 35 U.S.C. 154(b) by 64 days.

(21) Appl. No.: 14/132,190

(22) Filed: Dec. 18, 2013

(65) Prior Publication Data

US 2014/0322966 A1 Oct. 30, 2014

Related U.S. Application Data

(60) Provisional application No. 61/816,226, filed on Apr. 26, 2013.

(51) Int. Cl.
*H01R 9/05* (2006.01)
*H01R 13/506* (2006.01)

(52) U.S. Cl.
CPC ..... *H01R 9/05* (2013.01); *H01R 13/506* (2013.01)

(58) Field of Classification Search
CPC ..... H01R 9/05; H01R 13/506
USPC ..... 439/578–581, 675
See application file for complete search history.

(56) References Cited

U.S. PATENT DOCUMENTS

| | | | | |
|---|---|---|---|---|
| 4,659,166 | A * | 4/1987 | Morningstar et al. | 439/580 |
| 4,889,500 | A | 12/1989 | Lazar et al. | |
| 5,906,511 | A | 5/1999 | Bozzer et al. | |
| 2002/0189848 | A1 | 12/2002 | Hawker et al. | |
| 2011/0017491 | A1 | 1/2011 | Lu et al. | |
| 2013/0051733 | A1 | 2/2013 | Gallegos et al. | |

OTHER PUBLICATIONS

Internal Search Report and Written Opinion dated May 1, 2014.

* cited by examiner

*Primary Examiner* — Javaid Nasri
(74) *Attorney, Agent, or Firm* — Grogan, Tuccillo & Vanderleeden, LLP

(57) ABSTRACT

A multi-core cable terminating housing includes an upper case and a lower case. The upper case has a first plurality of grooves; the lower case has a second plurality of grooves; the grooves and the cases are shaped for mating with each other. Mating of the upper case with the lower case defines a cable plenum and a cable egress, and joins the first plurality of grooves with the second plurality of grooves to define a plurality of collars that open in parallel alignment from the cable plenum toward a front side of the housing opposite the cable egress, for receiving cable terminating connectors.

8 Claims, 2 Drawing Sheets

GANGED HOUSING FOR COAXIAL CABLE CONNECTORS

CROSS-REFERENCE TO RELATED APPLICATION

This application claims the benefit of U.S. Provisional Application Ser. No. 61/816,226, filed on Apr. 26, 2013, which is herein incorporated by reference in its entirety.

BACKGROUND

1. Technical Field

The present invention relates to electrical cable connections. Particular embodiments of the invention relate to arrays of multiple cable connections.

2. Discussion of Art

Computers and similar devices can be connected to share and exchange information via computer networks. A common type of computer network is a local area network ("LAN") which will typically employ a data communication protocol (LAN standard), such as Ethernet, FDDI or token ring, that defines the functions performed by data link and physical layers of a communications architecture (i.e., a protocol stack). The various IEEE 802.11 standards ("WiFi") are expected to become the predominant computer network protocols for most applications. However, certain applications will continue to require fixed line connections in order to comply with particular industry standards. Various types of cable can be used for implementing a fixed line network, depending on the LAN standard that is used. For example, although UTP (unshielded twisted pair) cabling is conventional for Ethernet, Ethernet protocol also can be implemented using 50- or 75-ohm coaxial cable.

Within a LAN, a switch or router is a computer that includes a plurality of ports that couple the switch to the other computers within or outside the LAN. Often, the router may be located remotely from some or all of the other computers in order to comply with particular application requirements. For example, the router may be maintained in a controlled-access location while the other computers remain accessible to general users or to the public. Accordingly, it may be necessary to run multiple cables in a bundle from the user location to the router location. For various reasons, it may also be necessary to periodically disconnect and reconnect the cable bundle at the router, without mixing up which cable goes to which port of the router.

BRIEF DESCRIPTION

According to embodiments of the invention, a housing is provided for rapidly connecting or removing plural coaxial cable connectors to or from regularly positioned ports of a router or similar device.

In one embodiment, the housing includes an upper case having a first plurality of grooves, and a lower case having a second plurality of grooves. The lower case is shaped to mate with the upper case. Mating of the upper case with the lower case defines a cable plenum and a cable egress, and joins the first plurality of grooves with the second plurality of grooves to define a plurality of collars that open in parallel alignment from the cable plenum toward a front side of the housing opposite the cable egress, for receiving cable terminating connectors.

In another embodiment, a multi-core cable includes a plurality of conductors, each conductor having a respective terminating connector; and a housing including a plurality of collars, each collar holding a respective one of the terminating connectors in parallel alignment with each other of the terminating connectors.

These and other objects, features and advantages of the present invention will become apparent in light of the detailed description of the best mode embodiment thereof, as illustrated in the accompanying drawings.

DRAWINGS

DETAILED DESCRIPTION OF THE DRAWING

Figure 1:
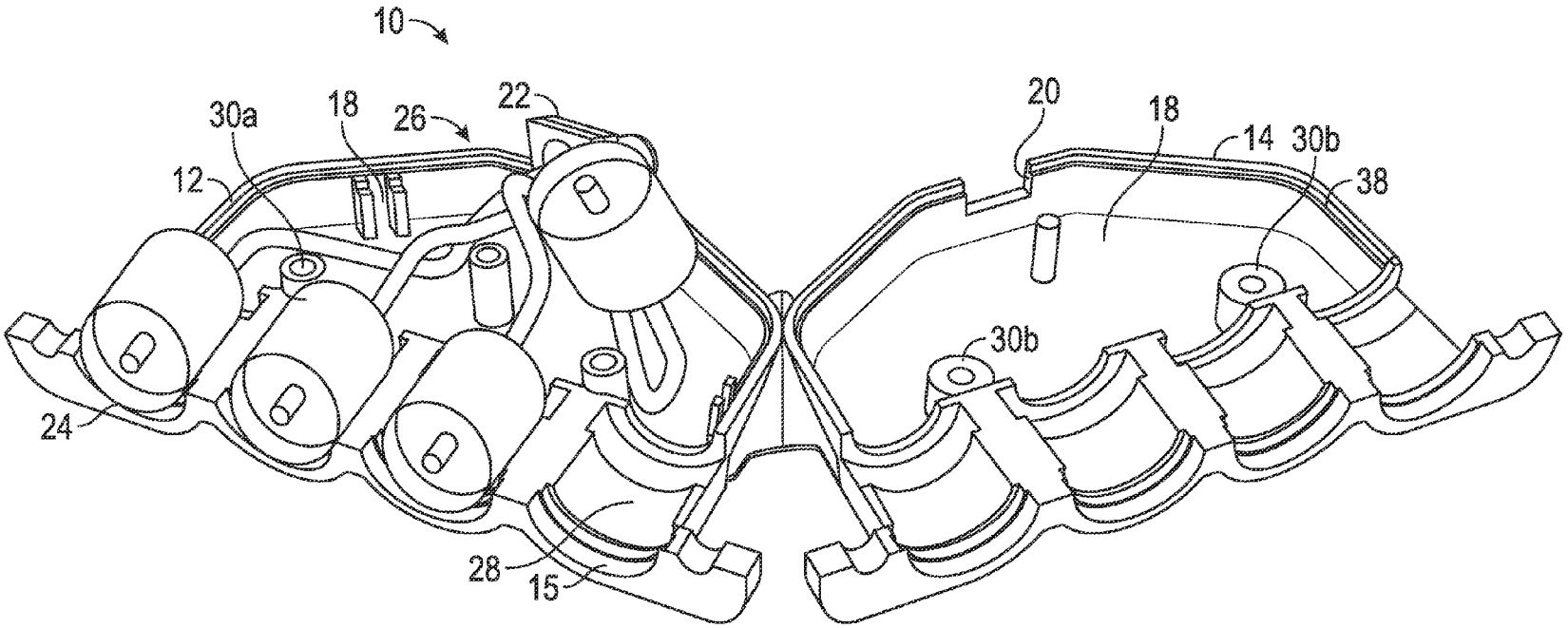
FIG. 1 is a perspective view of separated upper and lower cases of a ganged housing for coaxial cable connectors, according to an embodiment of the present invention.
Figure 2:
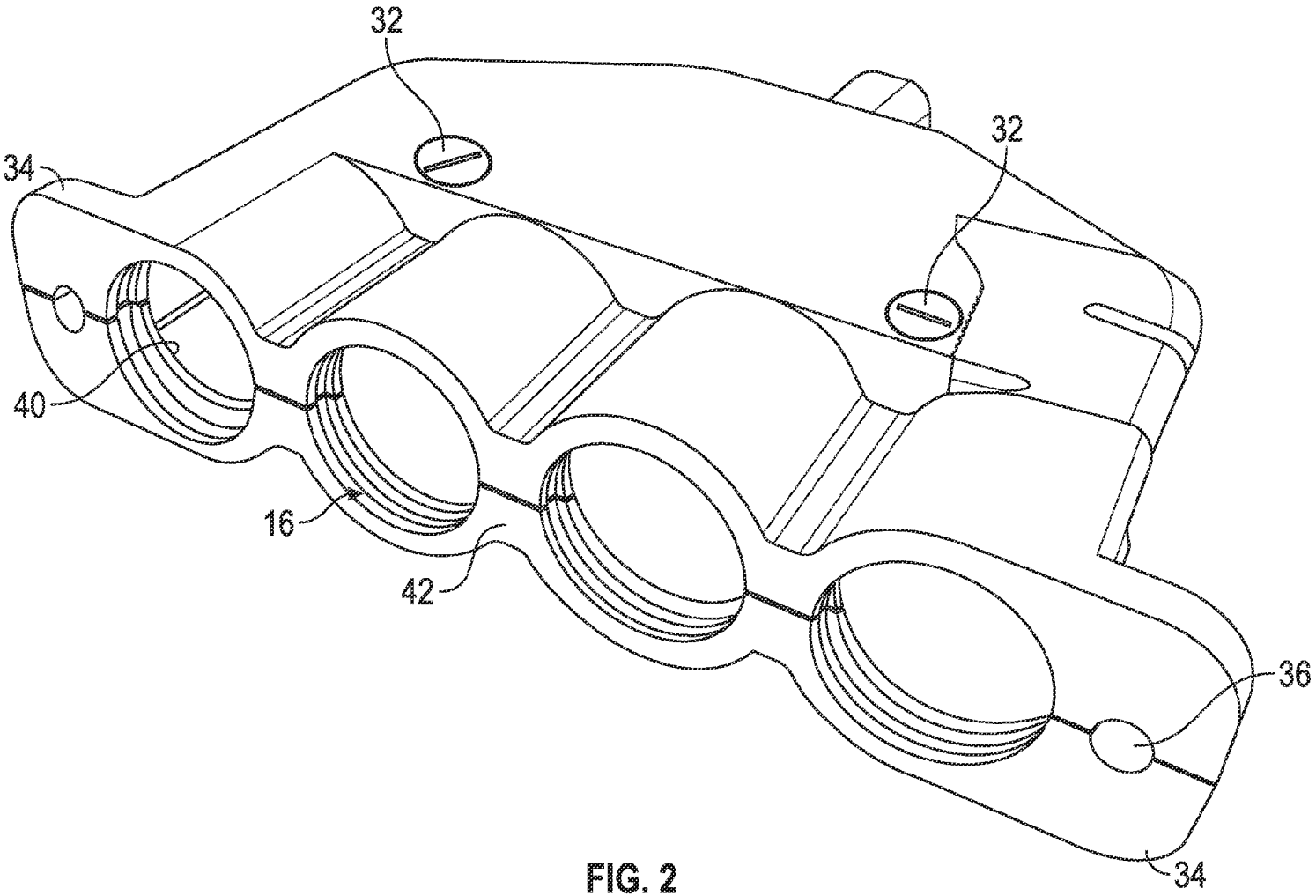
FIG. 2 is a perspective view of the assembled upper and lower cases of the ganged housing shown in FIG. 1.

An embodiment of the invention provides a ganged housing 10, as shown in FIGS. 1 and 2, for reliably receiving and gripping coaxial cable connectors that terminate the multiple cores of a multi-core cable. The inventive housing 10 includes an upper case 12 and a lower case 14, which each have, at a front side, grooves 15 that mate with the grooves of the other case to define an array of connector collars 16 (FIG. 2). The upper case 12 and the lower case 14 can be fastened together (e.g., by threaded fasteners; by rivets; by adhesives; by welding; by latches; etc.) to define a cable plenum 18, and a cable egress 20, as shown in FIG. 1.

To use the housing 10, a multi-core coaxial cable 22 (shown in FIG. 1) is placed in the cable egress portion 20 of the upper case 12 or of the lower case 14, and the terminating connectors 24 of the cable are placed in the connector collars 16, with the pigtail 26 of the multi-core cable being arranged within the cable plenum 18. In this condition, the connector collars 16 hold the terminating connectors 24 in parallel alignment such that all of the connectors simultaneously can be connected to or disconnected from a matching array of router ports. The terminating connectors 24 may be held in a linear array as shown, or in any other configuration corresponding to a known grouping of router ports. The upper case 12 and the lower case 14 then are fastened together to grip the terminating connectors 24 in the connector collars 16.

Optionally, one or more of the grooves 15 is internally marked with a positioning index 28 (e.g., a number) indicating what cable terminator should be placed in that collar. For example, in an exemplary application, a quad-core coaxial cable may carry four distinct data streams from four ports of a single router to four distinct computers within a network. The indicia 28 can inform a technician how to place the cable terminators 24 such that each computer is connected via the multi-core cable to its corresponding port of the router.

It is helpful if one of the upper case 12 or the lower case 14 also includes one or more orientation marker(s) 30 so that the housing 10 can be properly connected to the array of router ports. For example, the upper case 12 includes plastic sleeves **30*a* for loosely receiving threaded fasteners while the lower case 14 includes plastic pads 30*b* for threadedly gripping threaded fasteners. Thus, as shown in FIG. 2, the heads 32 of the threaded fasteners will serve as orientation markers on the upper case 12, indicating which way up to install the housing 10 onto a router. However, in embodiments where threaded fasteners or rivets are not used, one or more orientation markers can be molded into an outer surface of the upper case 12**.

In certain embodiments, the upper case 12 and the lower case 14 can include tabs 34 with holes 36 for receiving fasteners to hold the housing 10 to a router body (not shown).

Additionally, adjacent to the tabs 34, outer walls 38 of the upper and lower cases 12, 14 can include recesses 40 that relieve the housing 10 from the cable ends 24 so as to reduce material requirements for molding the cases. In some embodiments (not shown) the reliefs can be continued across the housing 10, thereby further reducing material requirements, so that ribs 42 of the upper and lower cases 12, 14 do not touch between the tabs 34. However, sufficient rib structure is required to define the grooves 15 so that the terminal connectors 24 will be gripped in parallel alignment.

Although this invention has been shown and described in detail with respect to exemplary embodiments thereof, it will be understood by those skilled in the art that various changes in form and detail thereof may be made without departing from the spirit and the scope of the invention.

For example, variations of the housing 10 can be built to accommodate arrays of various other push-pull-type connectors, e.g., 8P8C, RJ45, USB, mini-DIN, D-sub, TOSLINK, ESCON, FDDI, etc. simply by adaptation of the collar shapes.

What is claimed is:

1. A multi-core cable terminating housing comprising:

an upper case having a first plurality of grooves extending from a first recess formed in the upper case to a first end face of the upper case; and a lower case having a second plurality of grooves extending from a second recess formed in the lower case to a second end face of the upper case, the lower case being shaped to mate with the upper case, wherein the first recess and the second recess define a cable plenum when the upper case is mated with the lower case, wherein the mating of the upper case with the lower case further defines a cable egress, and joins the first plurality of grooves with the second plurality of grooves to define a plurality of cylindrical collars that open in parallel alignment from the cable plenum toward a front side of the housing opposite the cable egress, for receiving cable terminating connectors, wherein the first end face and the second end face are substantially coplanar when the upper case is mated with the lower case and define the front side of the housing, and wherein an axial length of the collars generally corresponds to an axial length of the cable terminating connectors.

2. The housing as claimed in claim 1, wherein the plurality of collars are shaped to grip coaxial cable terminating connectors.

3. The housing as claimed in claim 1, wherein the upper case and the lower case are mated together by threaded fasteners.

4. The housing as claimed in claim 1, wherein the upper case and the lower case together define at least one relief recess in the housing adjacent the front side of the housing.

5. A multi-core cable comprising:

a plurality of conductors, each conductor having a respective terminating connector; and a housing including an upper case portion having a first recess and a plurality of first grooves extending from the first recess to a first end face of the upper case portion, and a lower case portion having a second recess and a plurality of second grooves extending from the second recess to a second end face of the lower housing;

wherein the upper case portion and lower case portion are matingly coupled to one another such that the first recess of the upper case portion and the second recess of the lower case portion define a cable plenum for receiving the plurality of conductors, the first end face of the upper case portion and the second end face of the lower case portion are coplanar and define an axial end face of the housing, and the plurality of first grooves and the plurality of second grooves define a plurality of cylindrical collars extending from the plenum to the axial end face;

wherein each collar of the plurality of collars holds a respective one of the terminating connectors in parallel alignment with each other of the terminating connectors.

6. The multi-core cable as claimed in claim 5, wherein the conductors are electrical conductors.

7. The multi-core cable as claimed in claim 5, wherein the conductors are optical conductors.

8. A method for rapidly connecting a plurality of cables to a plurality of regularly-arrayed ports, comprising:

providing a housing that includes an upper case portion having a first recess and a plurality of first grooves extending from the first recess to a first end face of the upper case portion, and a lower case portion having a second recess and a plurality of second grooves extending from the second recess to a second end face of the lower housing, wherein the upper case portion and lower case portion are matingly coupled to one another such that the first recess of the upper case portion and the second recess of the lower case portion define a cable plenum for receiving the plurality of cables, such that the first end face of the upper case portion and the second end face of the lower case portion are coplanar and define an axial end face of the housing, and such that the plurality of first grooves and the plurality of second grooves define a plurality of cylindrical collars extending from the plenum to the axial end face and which are arrayed in registration with the plurality of regularly-arrayed ports;

inserting into each of the plurality of collars a terminating connector of one of the plurality of cables; and positioning the housing to connect the plurality of terminating connectors to the plurality of regularly-arrayed ports.

* * * * *